US006444958B1

(12) United States Patent
Campbell

(10) Patent No.: US 6,444,958 B1
(45) Date of Patent: Sep. 3, 2002

(54) COOKING APPLIANCE AND METHOD OF COOLING THE SAME

(75) Inventor: Robert P. Campbell, Sacramento, CA (US)

(73) Assignee: general Electric Company, Schenectady, NY (US)

( * ) Notice: Subject to any disclaimer, the term of this patent is extended or adjusted under 35 U.S.C. 154(b) by 0 days.

(21) Appl. No.: 09/670,437

(22) Filed: Sep. 26, 2000

(51) Int. Cl.[7] ..... H05B 3/68; F24C 15/00
(52) U.S. Cl. ..... 219/460.1; 126/21 R
(58) Field of Search ..... 219/451.1, 452.11, 219/452.12, 460.1; 126/39 J, 39 K, 21 R, 21 A, 90 A, 92 A

(56) References Cited

U.S. PATENT DOCUMENTS 3,627,986 A * 12/1971 Anderson ..... 219/452.12
3,870,862 A * 3/1975 Doner ..... 219/452.12
4,241,718 A * 12/1980 Barnett ..... 126/21 R
4,551,600 A * 11/1985 Miyagawa et al. ..... 126/299 D
5,019,682 A * 5/1991 Lee ..... 126/21 A
5,446,268 A * 8/1995 Chen ..... 126/21 A

* cited by examiner

*Primary Examiner*—Sang Paik
(74) *Attorney, Agent, or Firm*—Pierce Atwood

(57) ABSTRACT

Improved cooling is achieved in a cooking appliance having a burner box including an air inlet and at least one burner assembly disposed therein. A control box containing control electronics is located adjacent to the burner box. The control box is provided with an air inlet and an air outlet for permitting a flow of cooling air therethrough. Also provided is a fan for causing cooling air to pass through the control box. The burner box air inlet is positioned so that cooling air exiting the control box via the control box outlet enters the burner box via the burner box inlet. In one preferred embodiment, an inner box is disposed in the burner box so as to define a compartment into which the cooling air flows.

17 Claims, 7 Drawing Sheets

COOKING APPLIANCE AND METHOD OF COOLING THE SAME

BACKGROUND OF THE INVENTION

This invention relates generally to cooking appliances such as cooktops and ranges and more particularly to cooling various electronic components in such appliances.

Modern cooking appliances increasingly incorporate electronic control systems for controlling operation of the appliance. These control electronics are ordinarily contained in a separate control box located in close proximity to the heated elements of the cooking appliance. Because the control electronics cannot survive the elevated temperatures generated by the cooking appliance, cooling air is blown through the control box for cooling the electronics therein. The spent cooling air is discharged outside of the appliance. To enhance the functionality of the electronic control system, various sensors and other electronics are also being utilized. These additional components are often placed in close proximity to the heated elements of the cooking appliance.

Extensive use of electronics is particularly common in cooking appliances having a glass-ceramic plate as the cooking surface. The glass-ceramic plate presents a pleasing appearance and is easily cleaned in that its smooth, continuous surface lacks seams or recesses in which debris can accumulate. The glass-ceramic plate also prevents spillovers from falling onto the heating elements below. Such cooking appliances typically include a number of heating units mounted under a smooth glass-ceramic plate. A utensil placed on the glass-ceramic plate is directly heated by energy radiated from the appropriate heating unit. Alternatively, the glass-ceramic plate is sufficiently heated by the heating unit so that the utensil is heated by conduction from the heated glass-ceramic plate.

In either case, provision should be made to avoid overheating the glass-ceramic plate. For most glass-ceramic materials, the operating temperature should not exceed 600–700° C. for any prolonged period. Under normal operating conditions, the temperature of the glass-ceramic plate will generally remain below this limit. However, conditions can occur that can cause this temperature limit to be exceeded. Commonly occurring examples include operating the appliance with a small load or no load (i.e., no utensil) on the cooking surface, using badly warped utensils that make uneven contact with the cooking surface, and operating the appliance with a shiny and/or empty utensil.

To protect the glass-ceramic plate from extreme temperatures, glass-ceramic cooktop appliances ordinarily have some sort of temperature sensor for monitoring the temperature of the glass-ceramic plate. If the glass-ceramic plate approaches its maximum temperature, the power supplied to the heating unit is reduced to prevent overheating. In addition to providing thermal protection, such temperature sensors can be used to provide temperature-based control of the cooking surface and to provide a hot surface indication, such as a warning light, after a burner has been turned off.

It is common to locate a temperature sensor beneath each heating unit. The temperature sensors are thus subject to the high temperatures generated in the appliance. Other types of sensors provided to enhance the functionality of the electronic control system are typically located in the hot regions of the appliance. Such sensors include sensors for detecting characteristics, such as the temperature, size or type, of a utensil placed on the cooking surface, sensors for detecting the presence or absence of a utensil, and sensors for detecting properties such as boiling state of the utensil contents.

These sensors are susceptible to failure because of the high temperatures they are exposed to. Accordingly, it is desirable to provide a cooking appliance in which temperature and other sensors are cooled to prolong their life.

BRIEF SUMMARY OF THE INVENTION

The above-mentioned need is met by the present invention, which provides a cooking appliance comprising a burner box having an air inlet and at least one burner assembly disposed therein. A control box containing control electronics is located adjacent to the burner box. The control box is provided with an air inlet and an air outlet for permitting a flow of cooling air therethrough. Also provided are means for causing cooling air to pass through the control box. The burner box air inlet is positioned so that cooling air exiting the control box via the control box outlet enters the burner box via the burner box inlet. In one preferred embodiment, an inner box is disposed in the burner box so as to define a compartment into which the cooling air flows.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
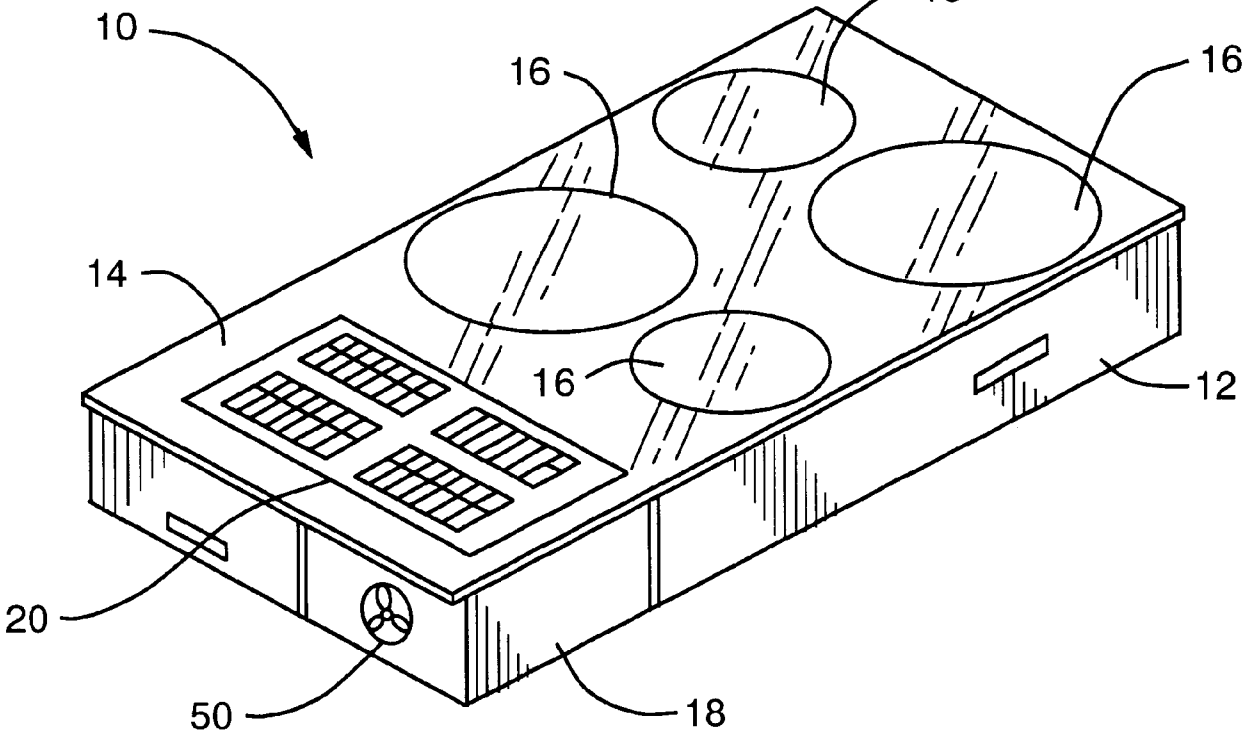
FIG. 1 is a perspective view of a cooking appliance.

Referring to the drawings wherein identical reference numerals denote the same elements throughout the various views, FIG. 1 shows a cooking appliance 10 having a housing or burner box 12 and a glass-ceramic plate 14 disposed on top of the burner box 12 to provide a cooking surface. Located directly underneath the plate 14 is a number (typically, but not necessarily, four) of burner assemblies (not shown in FIG. 1). Circular patterns 16 formed on the cooking surface of the plate 14 identify the position of each burner assembly. A control box 18 is located adjacent to the burner box 12 and under the plate 14. As is known in the art, the control box 18 contains control electronics (not shown) that control the operation of the appliance 10. A control panel 20 is provided on the plate 14. As is known in the field, the control panel 20 includes touch pads, knobs or the like that allow a user of the appliance 10 to interface with the control electronics and individually control the temperature of the burner assemblies.

The cooking appliance 10 shown in FIG. 1 is the type of cooking appliance, commonly referred to as a cooktop, that is designed to be mounted into a countertop. However, it should be noted that the present invention is not limited to cooktops, but is also applicable to other types of cooking appliances such as ranges. Furthermore, the present invention is not limited to glass-ceramic cooking appliances, as it is equally applicable to cooking appliances without glass-ceramic surfaces.

Figure 2:
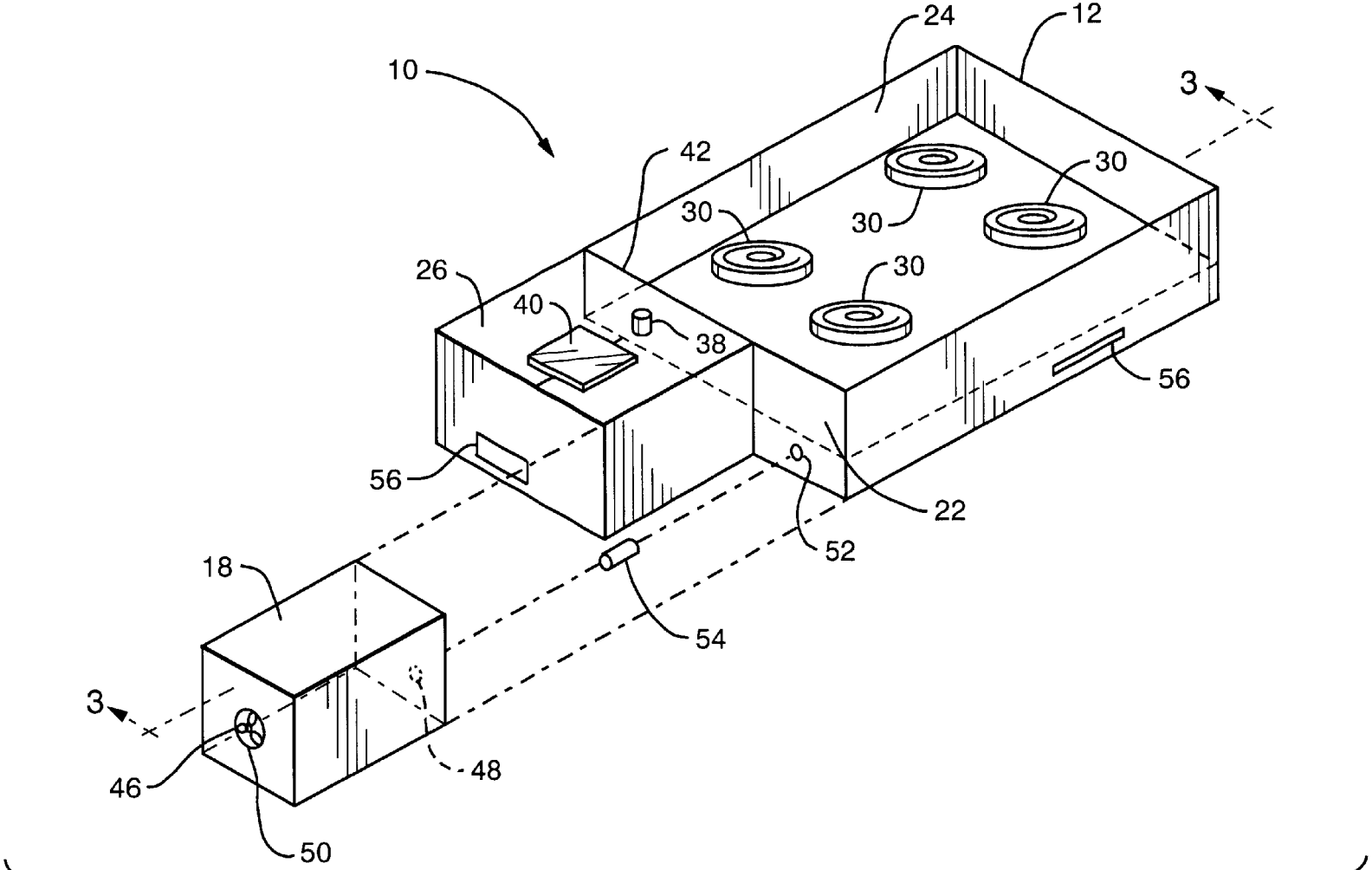
FIG. 2 is an exploded perspective view of the cooking appliance of FIG. 1 with the cooking surface removed.
Figure 3:
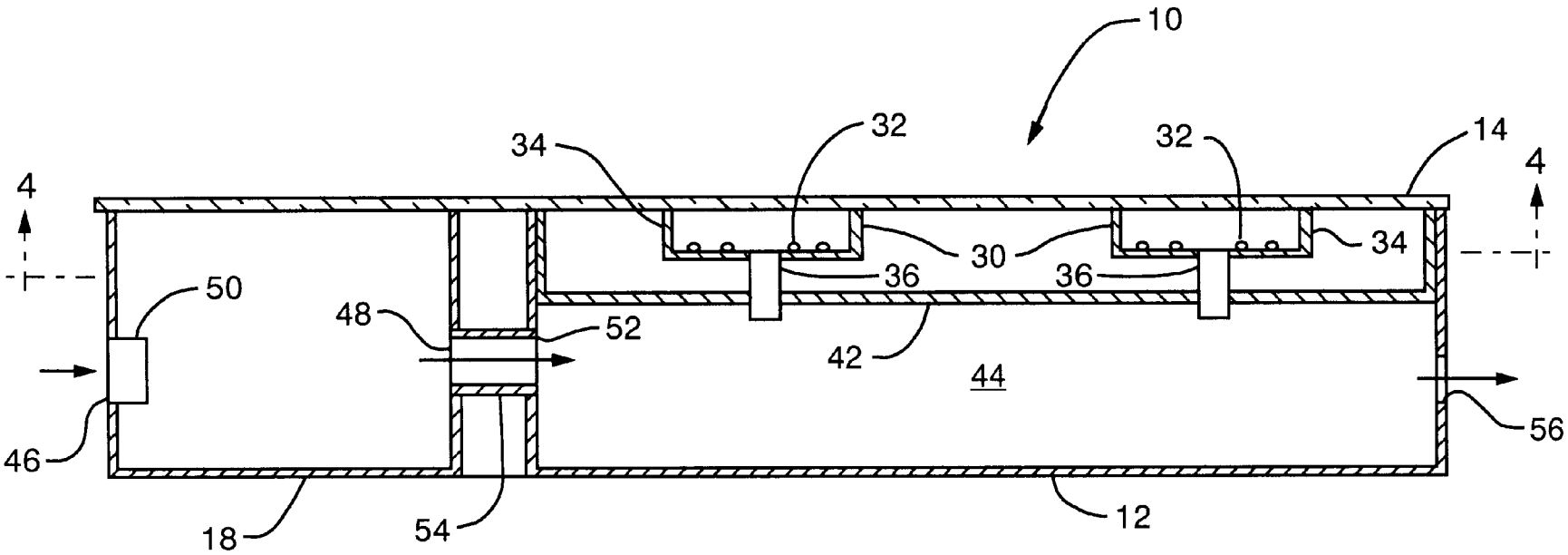
FIG. 3 is a sectional view taken along line 3—3 of FIG. 2.
Figure 4:
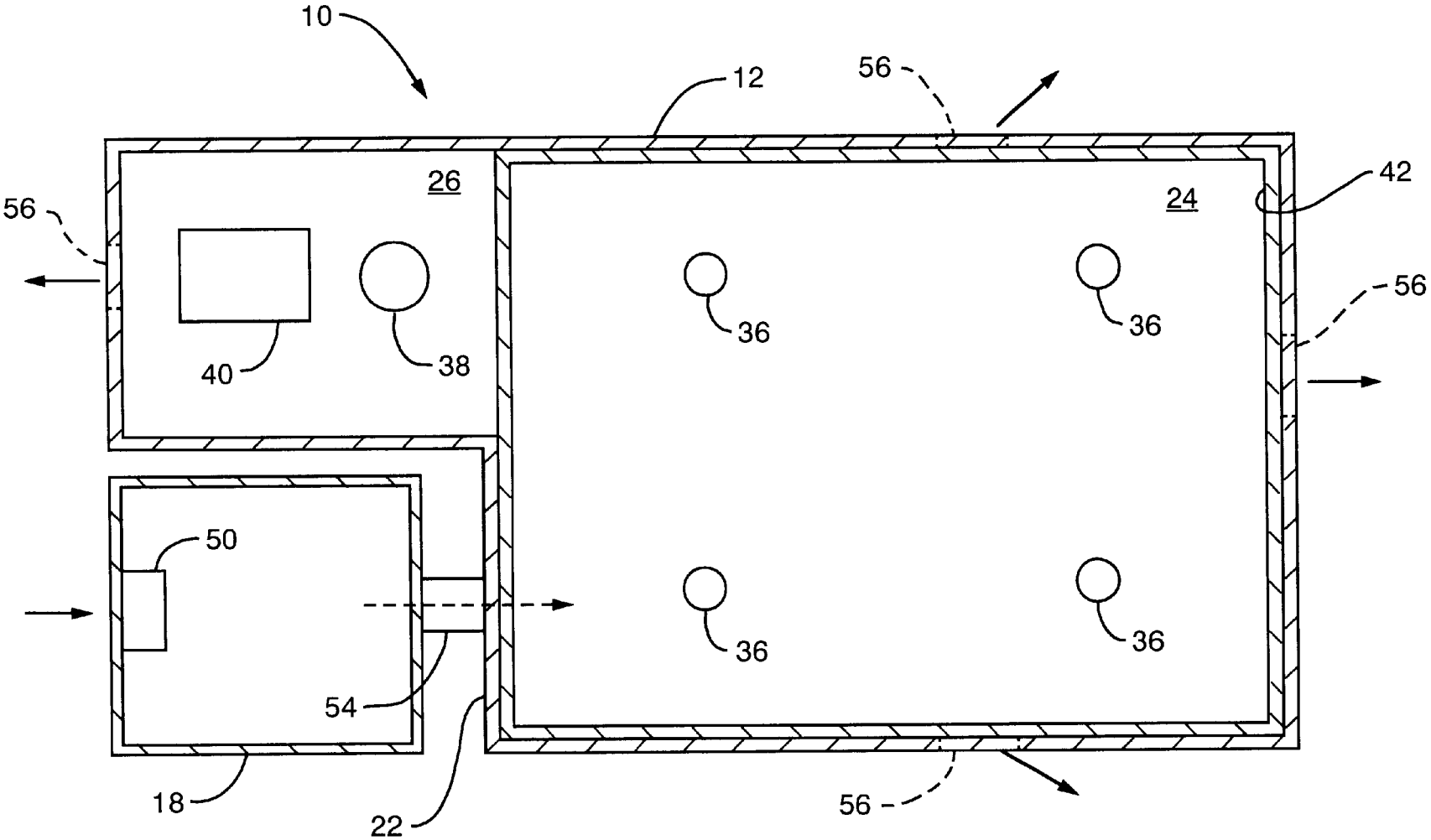
FIG. 4 is a sectional view taken along line 4—4 of FIG. 3.

Referring now to FIGS. 2–4, it is seen that the burner box 12 has a generally rectangular configuration except for a recess 22 set in one corner thereof into which the control box 18 fits. Thus, the burner box 12 comprises a primary section 24 and a smaller secondary section 26. The secondary section 26 extends laterally from the primary section 24 and has a smaller front-to-back dimension than the primary section 24 so as to define the recess 22. It should be noted that this recessed configuration is just one possible embodiment of the burner box 12 and that other configurations could be used as alternatives.

A plurality of burner assemblies 30 is disposed within the primary section 24 of the burner box 12, directly underneath the plate 14 (which is not shown in FIG. 2 for illustration purposes). Each burner assembly 30 includes a controllable energy source such as an open coil electrical resistance element 32. The heating element 32 is secured to a burner casing 34 that is supported under the glass-ceramic plate 14 in a conventional manner. A temperature sensor 36 is provided to sense the temperature of the glass-ceramic plate 14. The temperature sensor 36 is an optical device, such as an infrared thermometer or the like, although other types of temperature sensors could be used. The optical temperature sensor 36 is mounted in the burner casing 34, at the center of the coiled heating element 32, and is oriented so as to receive radiation from the portion of the glass-ceramic plate 14 directly above the burner assembly 30. In response to this radiation, the optical temperature sensor 36 generates a signal that corresponds to the temperature of the glass-ceramic plate 14. The temperature signal is supplied to the control electronics and used in the control of the cooking appliance 10. The body of the temperature sensor 36, which may be a cylinder of a high thermally conductive material that can function as a heat sink, extends downward from the burner assembly 30.

The secondary section 26 of the burner box 12 can contain other components that contribute to the control of the appliance 10. For example, an accelerometer 38 can be mounted in the secondary section 26.

The accelerometer 38, which measures vibrations, is able to provide an indication of when the contents of a utensil on the appliance 10 are boiling. User interface electronics 40 can also be located in the secondary section 26. Various other components could also be housed in the secondary section 26.

An inner box 42 having approximately the same width and length dimensions as the inner box primary section 24 is disposed in the upper portion of the primary section 24. As best seen in FIG. 3, the inner box 42 has a smaller depth than the burner box 12 so that a compartment 44 is defined between the base of the inner box 42 and the base of the burner box 12 in the primary section 24. The inner box 42 encloses the burner assemblies 30 so as to separate them from the compartment 44. However, the bodies of the temperature sensors 36 extend through the base of the inner box 42 into the compartment 44. The compartment 44 is in fluid communication with the interior of the secondary section 26.

The control box 18 has an air inlet 46 formed in one side thereof and an air outlet 48 formed in an opposite side. A fan 50 is located at the air inlet 46 for blowing ambient cooling air into the control box 18 via the air inlet 46. The cooling air passes through the control box 18, thereby cooling the control electronics therein, and exits the control box 18 via the air outlet 48.

The temperature of the cooling air exiting the air outlet 48 will be elevated above ambient temperature because it has removed heat from the control electronics. However, this air still has cooling capacity. Thus, instead of simply discarding this air by discharging it back to the ambient, it is used to cool components in the burner box 12. Specifically, an air inlet 52 is formed in the wall of the burner box 12 that forms the recess 22 and is adjacent to the control box air outlet 48. The burner box air inlet 52 is positioned in the wall so as to provide ingress to the compartment 44. A connector duct 54 extending between the control box air outlet 48 and the burner box air inlet 52 directs the air exiting the outlet 48 into the compartment 44. This air circulates in the compartment 44 and also flows into the secondary section 26.

As mentioned above, a portion of each temperature sensor 36 extends into the compartment 44. Thus, the temperature sensors 36 are cooled by the air circulating in the compartment 44. Similarly, the accelerometer 38 and the user interface electronics 40 are cooled by the air passing into the secondary section 26. Exhaust vents 56 are formed at various locations in the burner box 12 to exhaust the cooling air. Exhaust vents 56 are positioned about the primary section 24 such that cooling air will flow past each of the temperature sensors 36. Another exhaust vent 56 is formed in the secondary section 26, on the wall opposite the primary section 24, to insure a flow of cooling air through the secondary section 26 and past the accelerometer 38 and interface electronics 40.

It should be noted that the fan 50 can alternatively be located in the connector duct 54 between the control box 18 and the burner box 12, instead of at the control box air inlet 46. Thus, cooling air will be drawn into the control box 18 and across the control electronics and then blown into the compartment 44.

Figure 5:
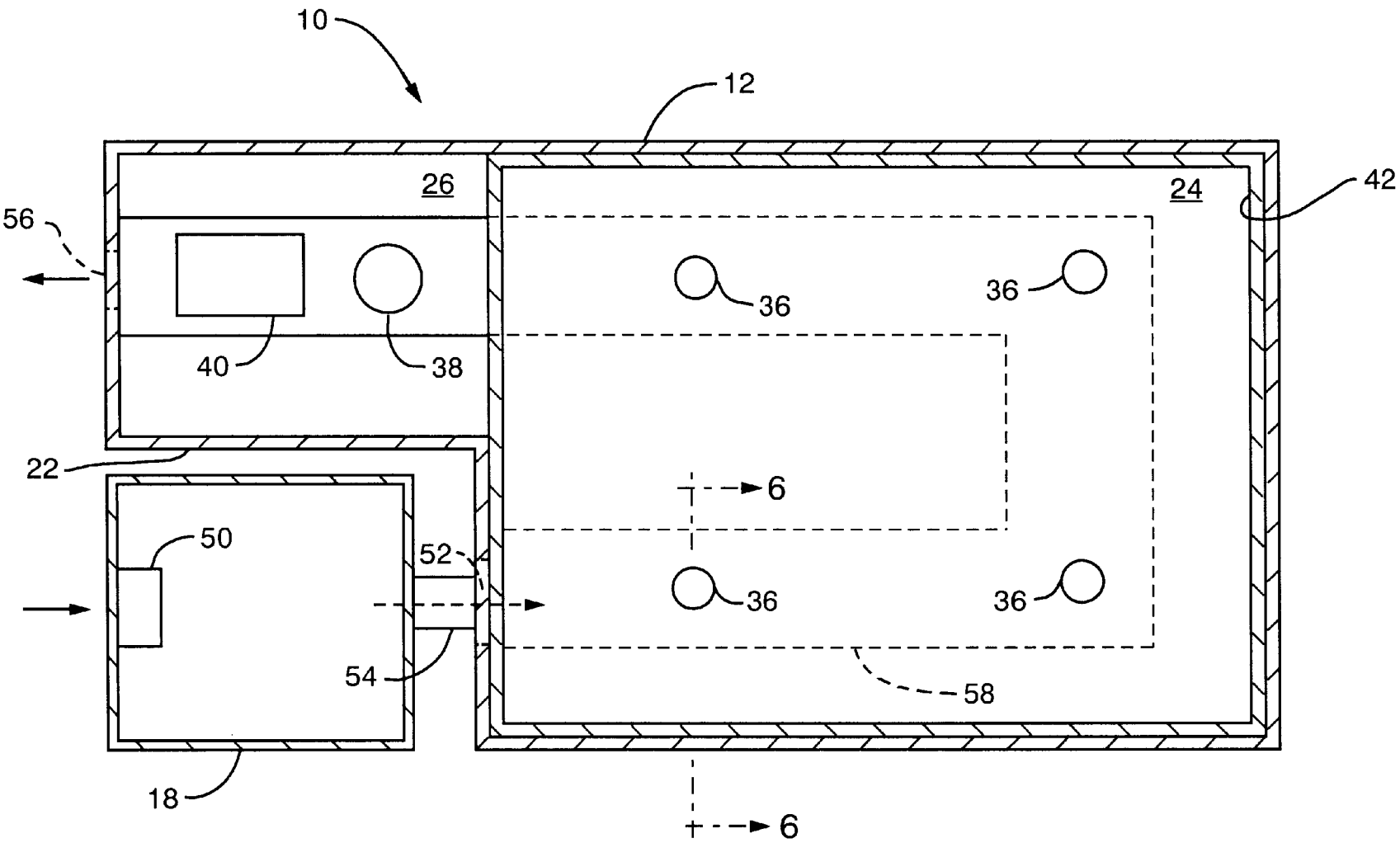
FIG. 5 is top sectional view of a second embodiment of a cooking appliance.
Figure 6:
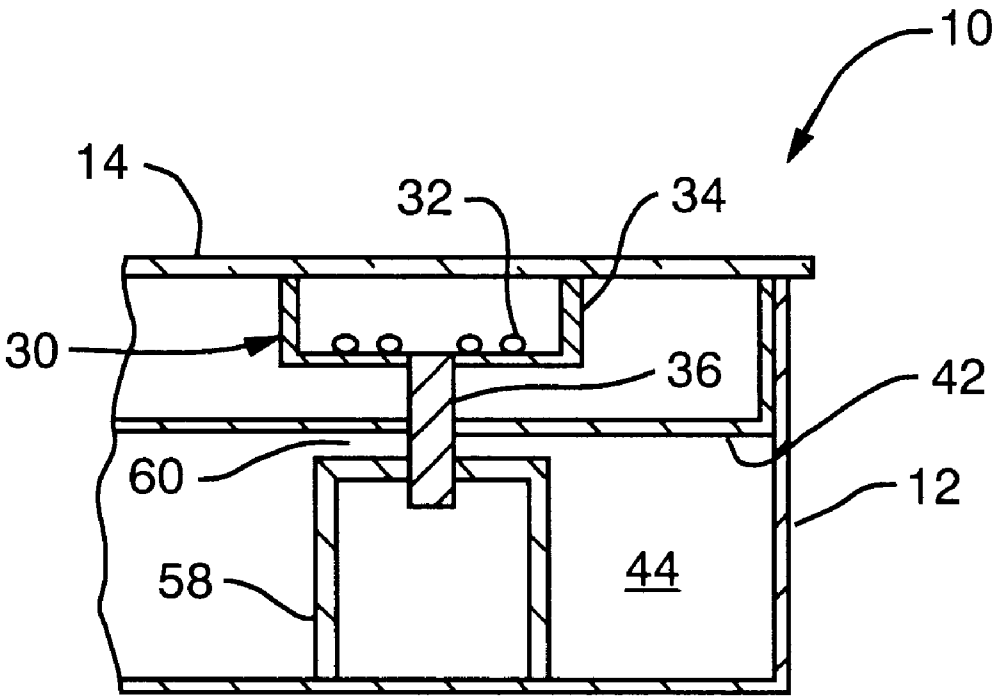
FIG. 6 is a sectional view taken along line 6—6 of FIG. 5.

Turning now to FIGS. 5 and 6, an alternative embodiment is shown. In this case, a duct 58 is placed in the burner box 12, under the inner box 42, for directing cooling air therethrough instead of allowing the air to freely circulate through the compartment 44 and the secondary section 26. The duct 58 is a three-sided structure that combines with the base of the burner box 12 to define an enclosed passageway. This passageway extends through the burner box 12 in a substantially U-shaped path that passes under each of the burner assemblies 30. The duct 58 thus directs cooling air past each of the temperature sensors 36, which extend through the top of the duct 58 into the passageway. The duct 58 also extends past the accelerometer 38 and the interface electronics 40 in the second section 26. A first end of the duct 58 is in aligned with the burner box air inlet 52, and the second end of the duct 58 is aligned with an exhaust vent 56 formed in the wall of the secondary section 26 that is opposite the primary section 24. Thus, cooling air exiting the control box 18 enters the duct 58 through the burner box air inlet 52, flows through the duct 58 and cools the temperature sensors 36, accelerometer 38 and interface electronics 40, and exits the duct 58 and the appliance 10 via the exhaust vent 56. In this embodiment, only the one exhaust vent 56 is used.

As best seen in FIG. 6, the duct height is such that an air gap 60 is formed between the bottom of the inner box 42 and the top of the duct 58. The air gap 60 provides some insulation between the duct 58 and the hot inner box 42, thereby preserving the cooling capacity of the air in the duct 58.

Figure 7:
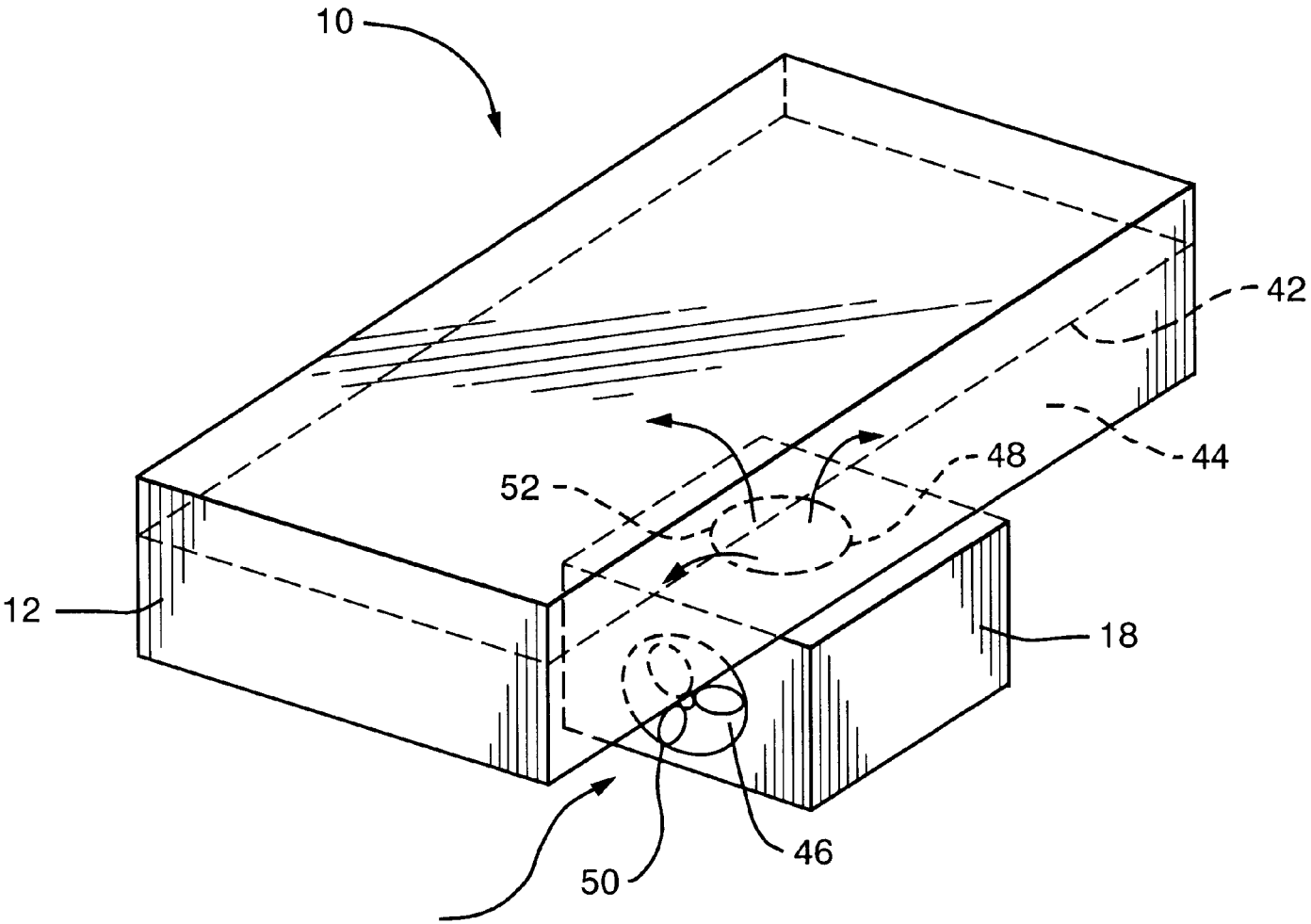
FIG. 7 is a schematic view of a third embodiment of a cooking appliance.

The present invention is not limited to cooking appliances in which the control box is located on the side of the burner box. FIG. 7 schematically shows another embodiment of a cooking appliance 10 in which the control box 18 is located below the burner box 12. In this case, the burner box air inlet 52 is located in the base of the burner box 12, aligned with the control box air outlet 48 formed in the top of the control box 18. Thus, air exiting the control box 18 flows into the compartment 44 defined between the base of the inner box 42 and the base of the burner box 12 via the burner box air inlet 52. Although FIG. 7 shows the air freely circulating in the compartment 44, this embodiment could also use a duct 58 for directing the cooling air through the compartment.

The foregoing has described a cooking appliance in which air used to cool the control electronics is used to cool other components in the burner box. While specific embodiments of the present invention have been described, it will be apparent to those skilled in the art that various modifications thereto can be made without departing from the spirit and scope of the invention as defined in the appended claims.

What is claimed is:

1. A cooking appliance comprising:

a burner box having an air inlet;

at least one burner assembly disposed in said burner box;

a control box located adjacent to said burner box, said control box containing control electronics and having an air inlet and an air outlet formed therein;

a duct disposed in said burner box; and means for causing cooling air to pass through said control box and over said control electronics via said control box air inlet and said control box air outlet, said burner box air inlet being positioned so that cooling air exiting said control box via said control box outlet enters said burner box via said burner box inlet, said duct receiving cooling air entering said burner box via said burner box inlet and directing it through said burner box.

2. The cooking appliance of claim 1 further comprising at least one component disposed in said burner box, said at least one component being cooled by said cooling air entering said burner box.

3. The cooking appliance of claim 1 wherein said means for causing cooling air to pass through said control box is a fan located at one of said control box inlet or said control box outlet.

4. The cooking appliance of claim 1 further comprising an inner box disposed in said burner box so as to define a compartment therebetween, wherein cooling air entering said burner box via said burner box inlet flows into said compartment.

5. The cooking appliance of claim 4 wherein said inner box encloses said at least one burner assembly.

6. The cooking appliance of claim 4 further comprising a duct disposed in said compartment, said duct receiving cooling air entering said compartment via said burner box inlet.

7. The cooking appliance of claim 6 wherein said at least one burner assembly includes a temperature sensor, a portion of said temperature sensor extending into said duct to be cooled by cooling air therein.

8. The cooking appliance of claim 1 further comprising a connector duct extending between said control box air outlet and said burner box air inlet.

9. The cooking appliance of claim 1 further comprising at least one exhaust vent formed in said burner box.

10. A cooking appliance comprising:

a burner box having an air inlet;

an inner box disposed in said burner box so as to define a compartment therebetween;

a plurality of burner assemblies disposed in said inner box;

a control box located adjacent to said burner box, said control box containing control electronics and having an air inlet and an air outlet formed therein; and means for causing cooling air to pass through said control box and over said control electronics via said control box air inlet and said control box air outlet, said burner box air inlet being positioned so that cooling air exiting said control box via said control box outlet enters said compartment in said burner box via said burner box inlet.

11. The cooking appliance of claim 10 further comprising at least one component disposed in said burner box, said at least one component being cooled by said cooling air entering said compartment.

12. The cooking appliance of claim 10 wherein said means for causing cooling air to pass through said control box is a fan located at one of said control box inlet or said control box outlet.

13. The cooking appliance of claim 10 wherein said inner box encloses said plurality of burner assemblies.

14. The cooking appliance of claim 10 further comprising a duct disposed in said compartment, said duct receiving cooling air entering said compartment via said burner box inlet.

15. The cooking appliance of claim 14 wherein each one of said burner assemblies includes a temperature sensor, a portion of each temperature sensor extending into said duct to be cooled by cooling air therein.

16. The cooking appliance of claim 10 further comprising a connector duct extending between said control box air outlet and said burner box air inlet.

17. The cooking appliance of claim 10 further comprising at least one exhaust vent formed in said burner box.

* * * * *